US006632108B1

(12) United States Patent
Hohlfelder

(10) Patent No.: US 6,632,108 B1
(45) Date of Patent: Oct. 14, 2003

(54) TERMINAL BLOCK WITH SELF-LOCKING TERMINALS

(75) Inventor: Eric W. Hohlfelder, Madison, CT (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 09/686,286

(22) Filed: Oct. 11, 2000

Related U.S. Application Data

(62) Division of application No. 09/373,867, filed on Aug. 13, 1999, now Pat. No. 6,380,846.

(51) Int. Cl.[7] ..... H01R 9/22
(52) U.S. Cl. ..... 439/709; 439/781; 439/812
(58) Field of Search ..... 439/709, 720, 439/722, 781, 782, 811, 812

(56) References Cited

U.S. PATENT DOCUMENTS

| | | | | | |
|---|---|---|---|---|---|
| 2,726,381 | A | | 12/1955 | Verkuill | |
| 2,830,143 | A | | 4/1958 | Koopman | |
| 3,050,706 | A | * | 8/1962 | Kitscha | 439/781 |
| 3,340,497 | A | * | 9/1967 | Balint | 439/872 |
| 3,585,574 | A | * | 6/1971 | Drapkin et al. | 439/720 |
| 3,609,653 | A | * | 9/1971 | Wallo | 439/741 |
| 3,657,683 | A | * | 4/1972 | Grieshaber | 439/781 |
| 3,694,792 | A | * | 9/1972 | Wallo | 439/412 |
| 3,904,266 | A | * | 9/1975 | Fitzpatrick | 439/570 |
| 4,017,844 | A | | 4/1977 | Facchini et al. | |
| 4,174,147 | A | * | 11/1979 | Waddington et al. | 439/636 |
| 4,210,379 | A | * | 7/1980 | Vachhani et al. | 439/406 |
| 4,343,529 | A | * | 8/1982 | Reavis et al. | 29/884 |
| 4,542,953 | A | * | 9/1985 | Iwamoto et al. | 439/717 |
| 4,551,707 | A | | 11/1985 | Simpson | |
| 4,638,297 | A | | 1/1987 | Roots | |
| 4,944,684 | A | * | 7/1990 | Leibowitz | 439/76.2 |
| 5,994,989 | A | * | 11/1999 | Rowe et al. | 335/202 |

OTHER PUBLICATIONS

The American Heritage Dictionary of the English Language, Third Edition copyright 1992 by Houghton Mifflin Company. Electronic version licensed from INSO Corporation.*
NOTIFIER brochure, "NBG–10 Series Non–Coded Manual Fire Alarm Station," 1995 (2 pages).
NOTIFIER brochure,"BGX–101L Addressable Manual Pull Station," 1995 (2 pages).
Three photographs (front, inside, rear) of NOTIFIER Model BGX–101L Non–Coded Fire Alarm Box.
NOTIFIER brochure, "BNG & BRG Series Manual Fire alarm Stations," 1995 (2 pages).
NOTIFIER brochure, "LNG Double–Action Manual Fire Alarm Station,"(2 pages).
Two photographs (front and rear) of NOTIFIER Model LNG–1 R Pull Box.
NOTIFIER brochure, "Manual Alarm Station Wiring, Product Installation Document" (1 page).

(List continued on next page.)

*Primary Examiner*—Tho D. Ta
*Assistant Examiner*—James R. Harvey
(74) *Attorney, Agent, or Firm*—Welsh & Katz, Ltd.

(57) ABSTRACT

A pull station for an alarm includes a housing with a handle mounted for sliding movement within the housing. The housing includes a window for a user to access the handle for forcibly sliding the handle in a vertical direction. A latch is rotatably mounted to the handle and spring biased to rotate to a locked position upon sliding movement of the handle. The latch has a portion which moves to bear against a stationary element of the housing to establish the locked position. The housing can be opened to reset the handle without changing the state of the alarm. Closing of the housing automatically resets the alarm. An attached terminal block includes a plurality of U-shaped terminal elements each having a screw terminal, a solder lug and a press pin.

10 Claims, 15 Drawing Sheets

OTHER PUBLICATIONS

Signal Communications Corporation Advertisement, "You're in good company with SigCom." 1996 (1 page).
Federal Signal Corporation brochure, "MMPS–Modular Manual Pull System" (2 pages).
Federal Signal Corporation brochure, "Modular Manual Pull System Model MMPS", 1997 (4 pages).
Federal Signal Corporation brochure, "Modular Manual Pull System Model MMPS", 1996 (2 pages).
Federal Signal Corporation brochure, "Installation Instructions For Model MMPS Pull Stations" (2 pages).
ADI catalogue, "Accessories/Pull Staions" (1 page).
General Signal/Edwards brochure, "Non–Coded Fire Alarm Stations" 1990 (10 pages).
Thorn brochure, "Manual Alarm Stations" (2 pages).
Aames Security Corporation brochure, "Manual Staions" (2 pages).
ESL Sentrol Catalog, "103 Series Manual Fire Alarm Stations" (1 page).
Harrington brochure, "HSPS Series Explosion Proof Manual Pull Stations" (4 pages).
Harrington brochure, "FA50 Series Non–Coded Manual Pull Stations" (2 pages).
Harrington brochure, "FA60 Manual Non–Coded Stations" (2 pages).
Harrington brochure, "Manual Fire Alarm Stations Weatherproof" (2 pages).
Cerberus Pyrotronics brochure, "MS–151 and MS–157 Manual Fire Alarm Station" 1993 (2 pages).
Cerberus Pyrotronics brochure, "Intelligent Initiating Devices Manual Station" (3 pages).
Gamewell brochure, "IdentiFlex 600 Series Addressable Manual Station (MS–95)" 1994 (2 pages).
Signal Communications Corporation brochure, "Fire Alarm Systems Accessories" 1996 (4 pages).
Fire Control Instruments brochure, "MS–2 Series Non–Coded Double Action Manual Fire Alarm Station" (2 pages).
Fire Control Instruments brochure, "MS–6 Non–Coded Manual Fire Alarm Station" (2 pages).
Fire Control Instruments brochure, "MS–WS Series Weatherproof Manual Fire Alarm Station" (1 page).
NOTIFIER brochure, "MMX–101 Monitor Module" 1995 (2 pages).

* cited by examiner 100
193b
198
195
195
180
184
196
202a
202
193a
195
106
316
193
250
264
250a
250b
266
198
266
264
214
195
195
248
198
108
220a
134
136
162b
160
164
162a
152
165
144
138
148
150
163a
135
132
172
174
140
142
126

FIG. 8
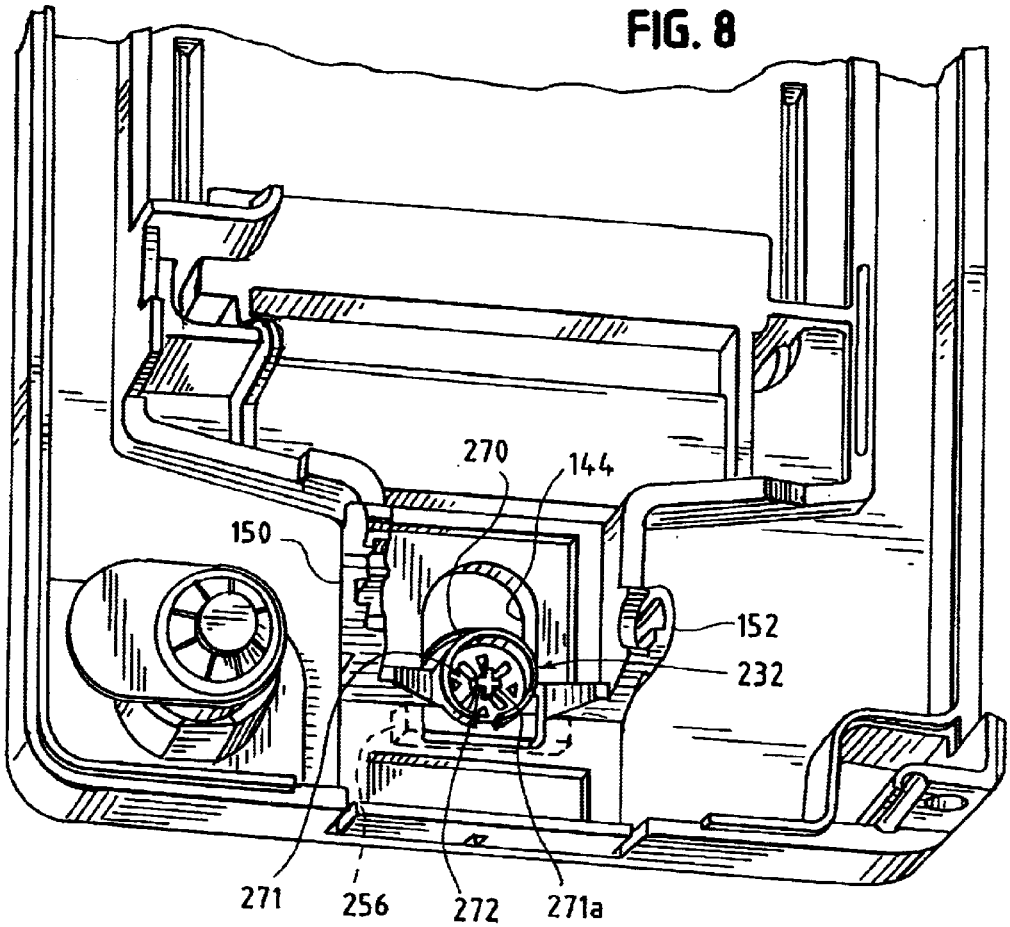
FIG. 9
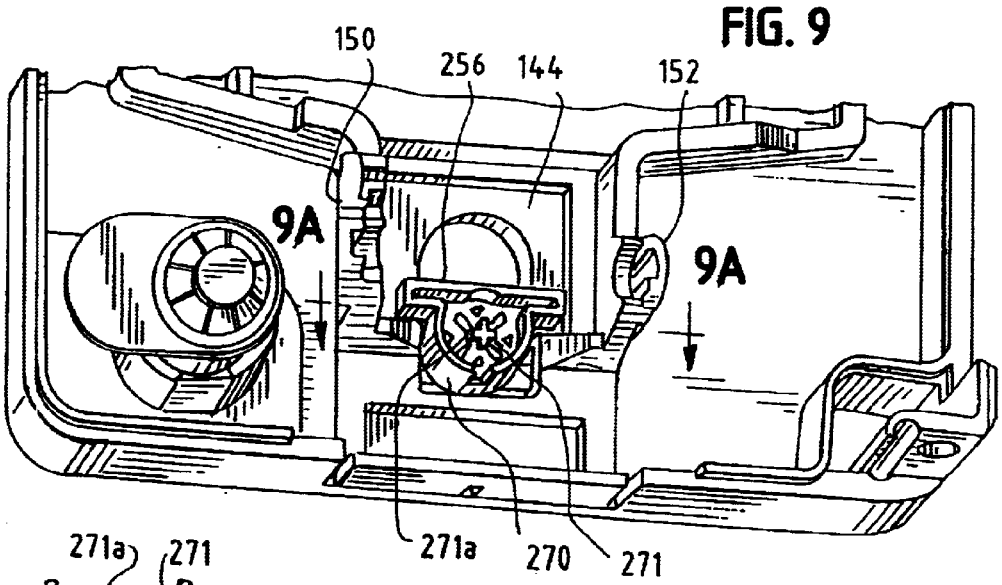
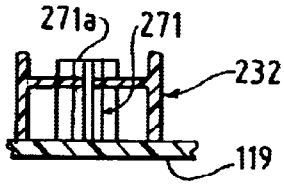
FIG 9A

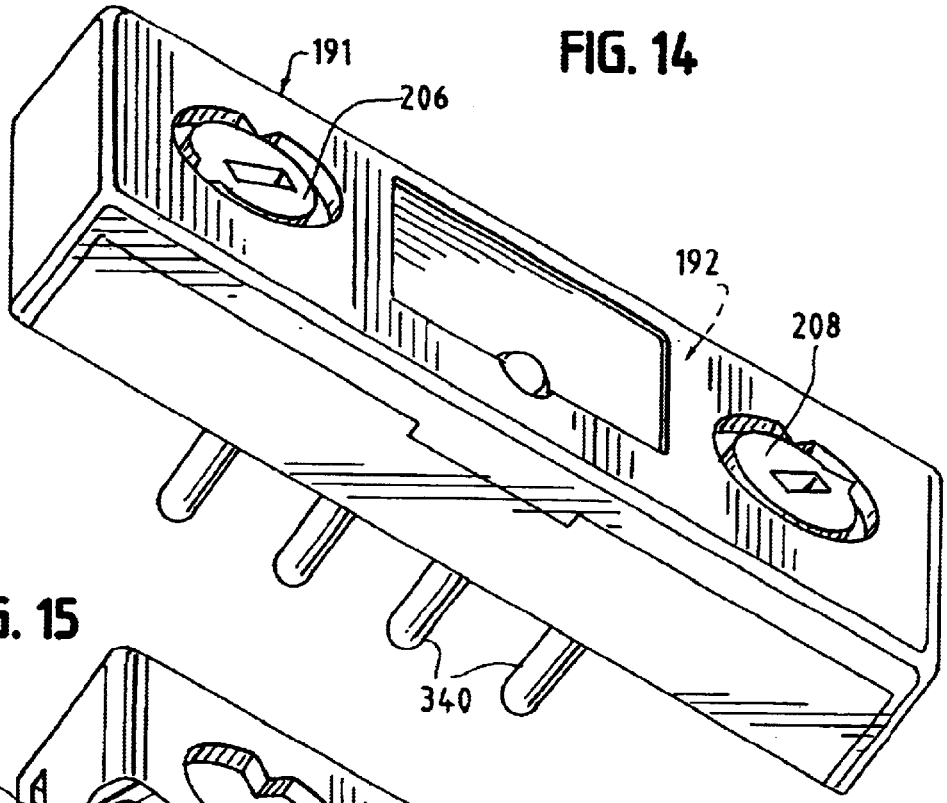
FIG. 14
FIG. 15
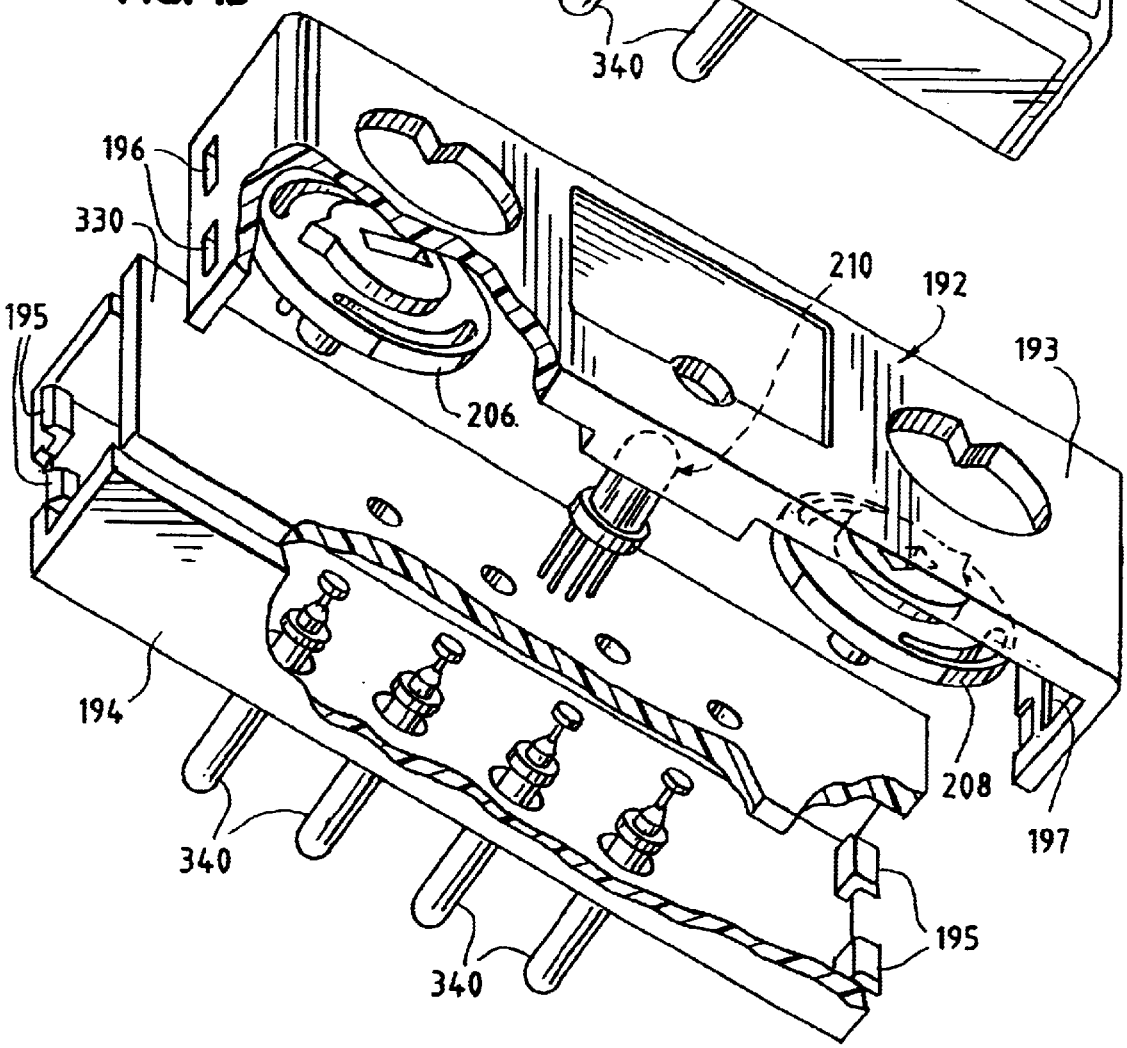

TERMINAL BLOCK WITH SELF-LOCKING TERMINALS

This application is a divisional application of U.S. Ser. No. 09/373,867 filed Aug. 13, 1999, now U.S. Pat. No. 6,380,846.

TECHNICAL FIELD OF THE INVENTION

The present invention relates to emergency pull stations, such as pull stations for triggering fire alarms.

BACKGROUND OF THE INVENTION

In known fire alarm pull stations, a lever is provided which can be manually pivoted or depressed to set off a local or centralized fire alarm. Such fire alarms are typically present in buildings such as schools, hospitals, and the like. The alarm pull stations mount on a wall and are typically color coded to be easily recognizable in an emergency.

Such pull stations are manufactured for example by Pittway Corporation, NOTIFIER Division, such as models: NBG-10 series Non-Coded Manual Fire Alarm Station, BGX-101L Addressable Manual Pull Station, BNG and BRG series Manual Fire Alarm Stations or LNG Double-Action Manual Fire Alarm Station.

To prevent vandalism or nuisance alarms involving such pull stations, the pull stations are configured to lock in the alarm state once the activation lever is depressed or otherwise placed in an alarm state. To reset a pull station, a key is required to release the lever to its initial, non-alarm state.

SUMMARY OF THE INVENTION

According to a first aspect of the invention, a pull station for an alarm system includes features adapted to enhance manufacturing, assembly and effectiveness of the pull station. The pull station includes a back plate or base plate which carries an alarm switch on a front side and a terminal block on a back side.

A cover is hingedly connected to the back plate. The cover carries a handle slidably held thereto that is accessible through an opening in a front wall of the cover. The handle is biased upwardly and when forcibly pulled downwardly, activates the alarm switch.

A latch is carried by the handle. The latch moves with the handle and engages an abutment of the back plate to prevent upward retraction of the handle, when the handle has reached its downward, alarm position.

A lock is mounted in an opening in the front wall of the cover. When locked, the lock fixes the cover to the back wall in a closed configuration. Once the handle is pulled to its alarm position, the lock must be unlocked, the cover opened and the latch disengaged from the abutment to retract the handle to reset the pull station.

The handle includes a body portion having a switch activator facing rearwardly thereof. The switch activator includes a structure which captures a switch lever of the alarm switch such that sliding movement of the body portion changes the state of the alarm switch. Additionally, a contoured ramp of the structure acts to reset the switch lever when the cover is pivotally closed to the back plate.

The body portion includes outwardly extending tabs on a top end thereof, on opposite lateral sides of the body portion, which are slidably captured in side channels of the cover. The handle also includes an extension portion connected to, such as being formed with, a lower end of the body portion.

The extension portion includes a front wall portion having an elongated slot, elongated in a direction of sliding movement of the body portion.

According to different fire codes, pull stations must have handles which operate in either a single action, such as a "pull down", mode or in a double action, such as a "press in and then pull down", mode. In a first, single action, configuration, an anchor portion having an outwardly directed stop portion is connected to a rear side of the cover front wall, the anchor portion having a circular base portion that penetrates the elongated slot. The stop portion overlies the front wall portion of the extension portion on lateral sides of the slot to capture the extension portion onto the cover front wall but which allows sliding of the extension portion with respect thereto.

In an alternate double action configuration, the anchor portion is mounted with the stop portion located between the extension portion and the front wall of the cover. The stop portion fits into stop grooves formed on the front side of the extension portion. In this orientation, the stop portion serves as a blocking member which abuts side walls of the stop grooves on a front surface of the extension portion and prohibits the handle from sliding downwardly unless the handle is first pushed in and then slid downwardly.

When pushed in, the stop portion clears the stop grooves and the handle can be slid downwardly. The spring loaded latch provides a resilient opposition or "feel" to pushing in the handle.

The extension portion includes substantially parallel side walls, extending from the extension portion front wall rearwardly. The latch is rotatably mounted between, and to, the side walls. A torsional spring biases the latch to rotate toward an engagement position, with a latch tip of the latch pressed against the back plate.

The back plate includes a stepped surface extending forwardly thereof and in registration with the latch. The stepped surface includes a forward surface parallel to a back surface of the front wall of the cover and arranged at a first distance from the back surface of the front wall of the cover, to be pressed by the latch tip. The stepped surface has a rearward surface parallel to the back surface of the front wall of the cover and arranged at a second distance from the back surface of the front wall of the cover, the second distance greater than the first distance. A perpendicular surface is formed between the forward and rearward surfaces.

During sliding of the handle with respect to the cover and back plate, the latch tip slides on the forward surface and, under force from the torsional spring, moves between the forward and rearward surfaces. In this position, an end of the latch, that is adjacent to the latch tip, can abut the perpendicular surface. The perpendicular surface, by abutment against the latch end, prohibits the latch element from proceeding in a reverse direction, which in turn prohibits the handle from being slid in a reverse direction.

In order to reset the handle to its elevated position, the cover must be unlocked and opened. When the cover is opened, the latch will disengage the stepped wall and the handle will be automatically retracted upwardly by the spring. When the cover is subsequently closed against the base plate, the latch will be forced to resiliently rotate to assume its position pressed against the forward surface of the stepped wall.

The exemplary embodiments of the invention reduce or eliminate fasteners in the assembly and include the ability to assemble the components in two configurations for two operating modes: a handle slide down only mode, and a handle press inwardly and then slide down mode. The pull station can be configured and assembled in either configuration without requiring different parts or fasteners. The cover is connected to the base plate without use of fasteners. The spring loaded latch is also snap fit to the handle, without requiring fasteners.

The handle is assembled to the cover without fasteners. In the first configuration, the handle is slid onto the cover at a top end of the handle, with the handle at about 90° to the cover, and then the handle is pivoted toward the cover 90° and secured by the anchor member with the stop portion overlying the extension portion. The handle is thus attached for sliding movement with respect to the back plate.

In the alternate configuration, the handle is slid onto the cover at the top end of the handle with the handle at 90° to the cover. The anchor member is comparatively oriented turned over and rotated 180° compared to the first configuration. The anchor member is attached to the cover. The handle is then pivoted toward the cover by about 90°.

The extension portion is guided by the anchor member for sliding movement, but not restrained against the cover, by the anchor member. The extension portion is urged toward the cover by the resilient pressing of the latch against the back plate.

The electric terminals which are mounted to a back of the pull station, are configured to be pressed in place using barbed legs of a U-shaped body. The terminals are set at a standard 0.375 inch spacing and each provides a solder lug, a screw terminal and a pin connector. The screw terminal is configured to accept a two wire lead. The U-shaped body provides an interior region or space for the threaded shaft of the screw terminal to enter.

According to another aspect of the invention, the handle can be composed of transparent or translucent material, such as plastic material. The switch module can include an LED status annunciator located behind the handle. A blinking of the LED for example can indicate a "ready" condition of the pull station.

According to another aspect of the invention, a PC board inside the housing can be mounted according to two orientations, to avoid covering the housing mounting holes for mounting the housing to an electrical box or other mounting structure or surface.

Also, the cover of the module includes the warning message, such as the word "FIRE", molded as a recess into the cover and the word is hot stamped in white within the recess.

Numerous other advantages and features of the present invention will become readily apparent from the following detailed description of the invention and the embodiments thereof, from the claims and from the accompanying drawings in which details of the invention are fully and completely disclosed as part of this specification.

BRIEF DESCRIPTION OF THE DRAWINGS

FIG. 8 is an enlarged fragmentary plan view of the cover of FIG. 4 illustrating a dual action configuration of the handle, anchor, and cover;

FIG. 9 is a fragmentary plan view of a modified cover illustrating a single action configuration of the anchor, handle, and cover;

FIG. 9A is a fragmentary sectional view taken generally along line 9A—9A of FIG. 9;

FIG. 14 is a perspective view of a monitor module taken from FIG. 13;

FIG. 15 is an exploded perspective view of the monitor module of FIG. 14;

DETAILED DESCRIPTION OF THE PREFERRED EMBODIMENTS

Figure 1:
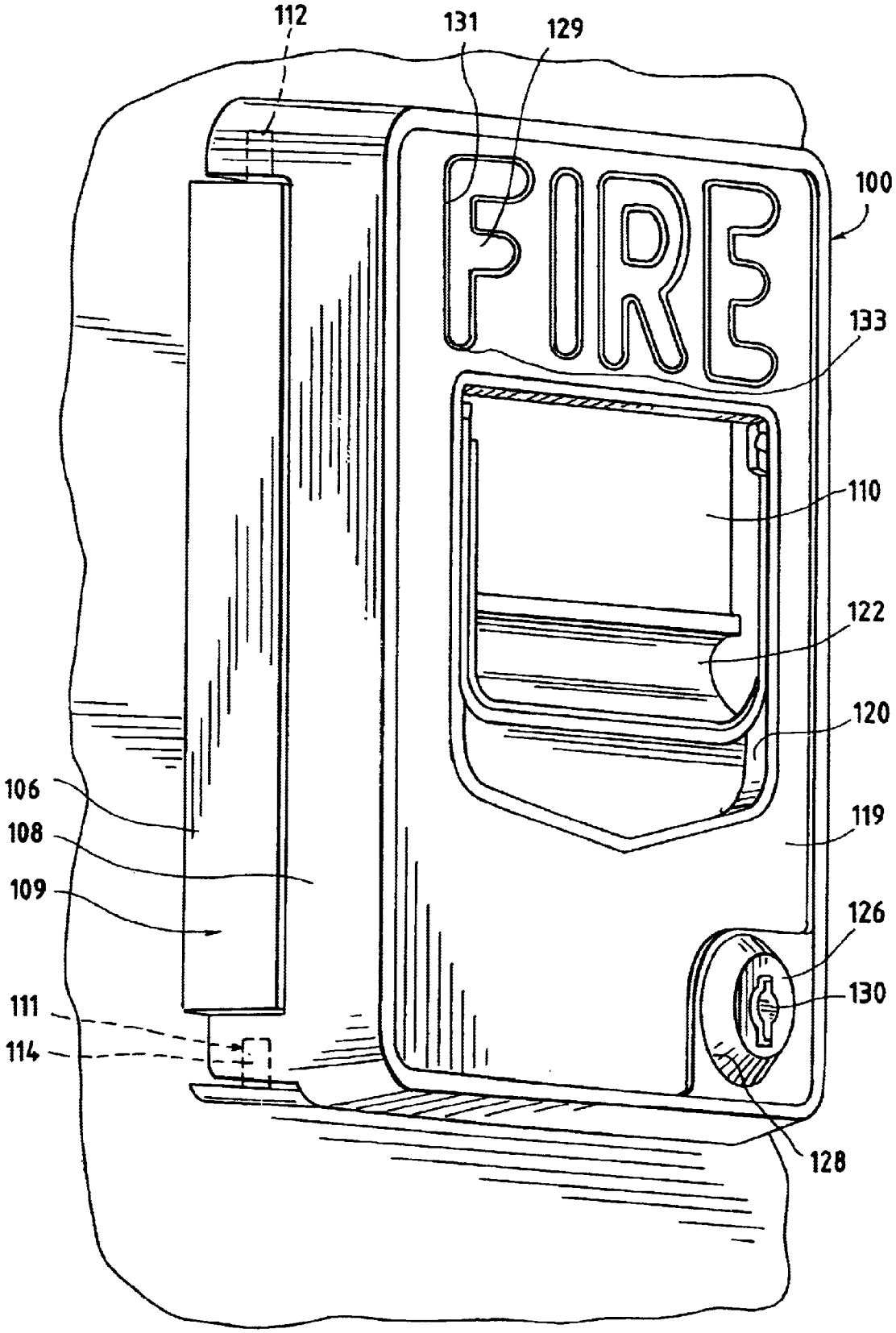
FIG. 1 is a perspective view of an assembled pull station of the present invention.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a pull station 100 having a baseplate 106, and a cover 108 which together form a housing 109. The pull station 100 includes a handle 110 arranged between the base plate 106 and the cover 108.

The cover 108 is hinged to the base plate by a releaseable hinge assembly 111 (shown in FIGS. 3 and 4) which includes upper and lower hinge pins 112, 114 respectively on the baseplate 100 and corresponding sockets 116, 118 on the cover. The cover 108 includes a front wall 119 having a window 120 which exposes a recessed gripping portion 122 of the handle to allow manual movement of the handle within the housing 109.

A lock cylinder 126 is carried by the front wall 119, exposed through an aperture 128 through the front wall 119. The lock cylinder includes a keyhole 130 for receiving a key or a tool to lock or unlock the free edge of the hinged cover 108 to/from the base plate 106.

For a fire pill station, the housing is usually red in color. The front wall 119 includes the lettering "FIRE" for example. The lettering is formed by hot stamping white letters 129 within wider, correspondingly shaped recesses 131, forming letter shaped grooves 133 into the front wall 119. The white letters 129 set into the red cover 119 are visually distinctive. Also, due to the presence of the grooves 133, even if the front wall 119 and the letters 129 are over-painted the same color, the letters as defined by the grooves 133, will still be visually perceptible. Preferably the grooves 133 have a significant aspect ratio (depth to width ratio) to prevent the obliteration of the lettering due to such an over-painting. The letters 129 have a front surface which is flush with the surrounding front surface 121 of the wall 119. Thus, if desired, a label can be smoothly applied over the letters 129 to apply a different message, such as a message in a foreign language.

Figure 2:
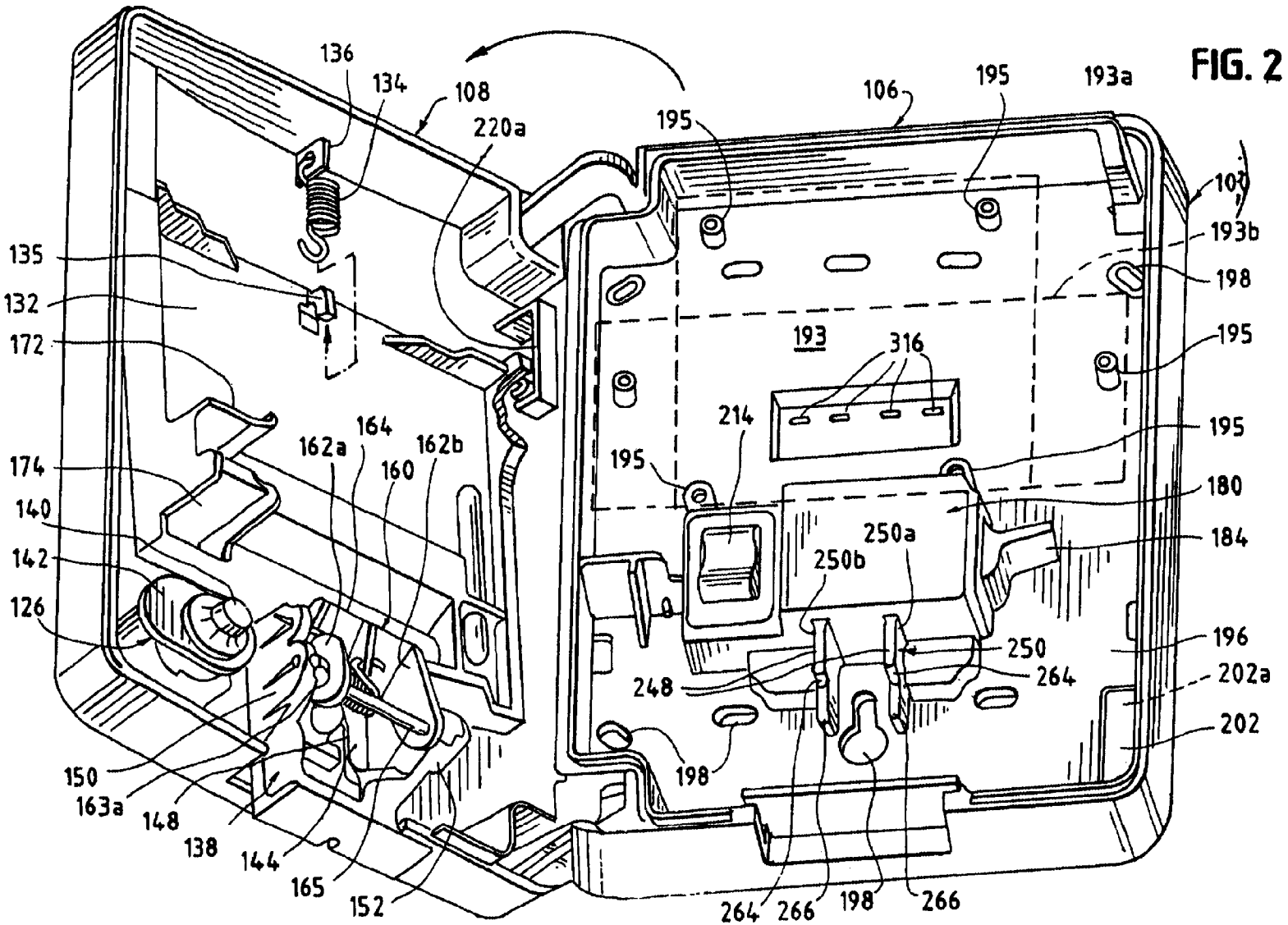
FIG. 2 is a perspective view of the pull station of FIG. 1 with a cover open with respect to a base plate.

FIG. 2 illustrates the housing 109 in an open configuration. The handle 110 includes a body portion 132 which is biased by a spring 134 to an elevated position on the cover 108. The spring 134 is connected to a hoop portion 136 on the cover 108 and to a hook portion 135 on the handle 110. For purposes of description, the spring is shown disconnected from the hook portion.

The handle 110 also includes a relatively narrow extension portion 138 connected to the body portion 132. The lock cylinder 126 includes an output shaft 140 which is connected to rotate a lock cam 142 upon turning of the key from a front side of the cover 108.

The extension portion 138 includes a front wall portion 144 having an elongated slot 148. The slot 148 is elongated in a vertical direction, i.e., the direction of movement of the handle 110.

The extension portion 138 further includes parallel side walls 150, 152 extending from the front wall portion 144 in a substantially perpendicular direction. A latch mechanism 160 is located between the side walls 150, 152 and is carried for rotation at each side wall 150, 152.

Figure 10:
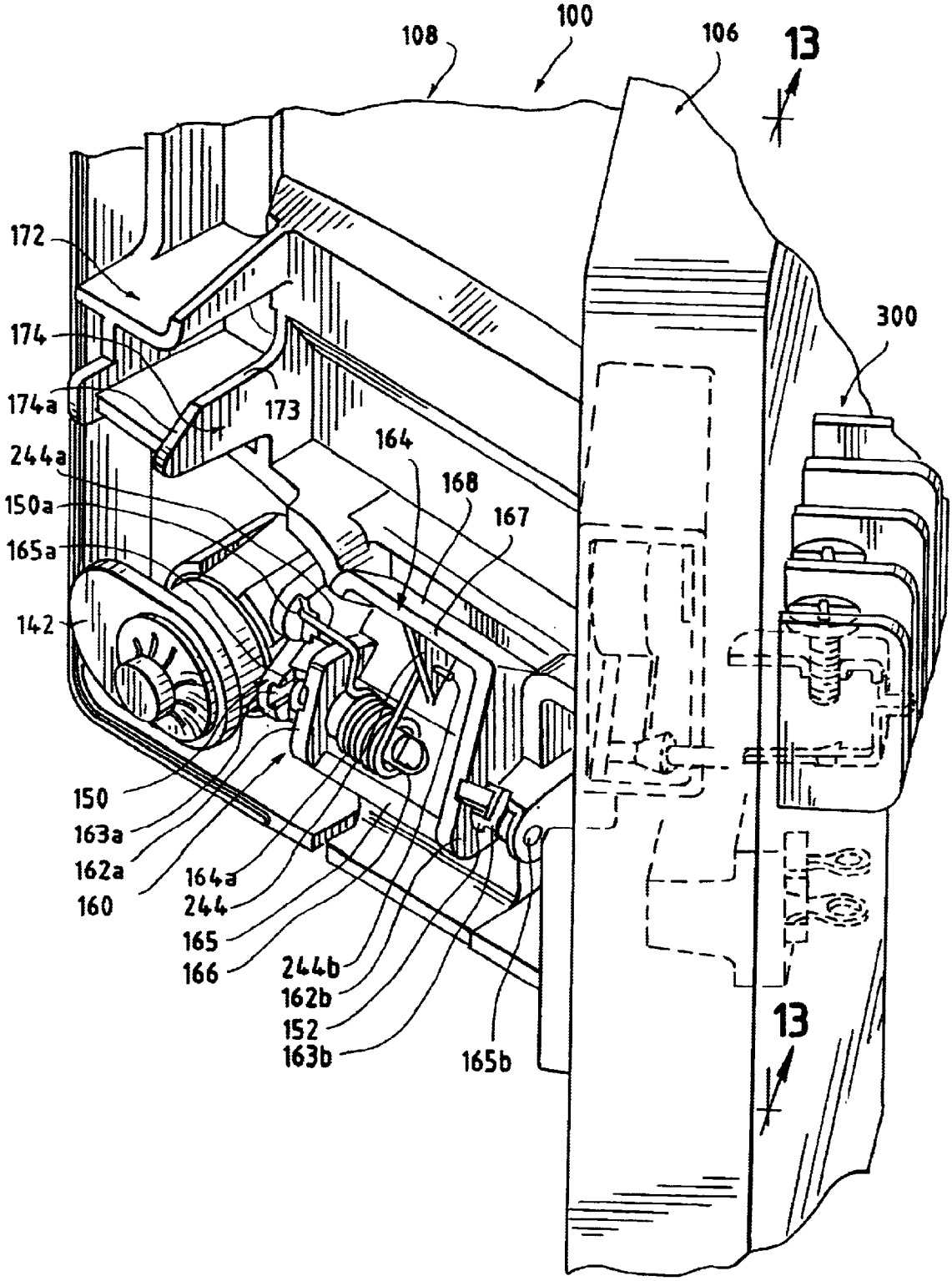
FIG. 10 is an enlarged fragmentary perspective view of the cover of FIG. 8 or 9.

As illustrated in FIGS. 2 and 10, the latch mechanism or "trigger", includes two sidewall portions 162*a*, 162*b* which fit between the side walls 150, 152. The side wall portions 162*a*, 162*b* carry cylindrical axle stubs 163*a*, 163*b* which extend outwardly from respective side wall portions 162*a*, 162*b* and are journalled for rotation into round sockets or holes 165*a*, 165*b* formed into the respective side wall 150, 152.

The side wall portions 162*a*, 162*b* carry therebetween a latch element 164 at an upper end and a brace bar 165 at a lower end. A spring guide rod 166 extends horizontally from the side wall portion 162*a* toward the side wall portion 162*b*. The latch element 164 includes a latch tip 167 and a latch end face 168. A torsion spring 244 surrounds the guide rod 166 and biases the latch element toward the back plate 106.

The body portion 132 also includes a switch activating wall 172 and a switch deactivating wall 174 having a ramped portion 174*a*. The base plate 106 includes a covered switch element 180. The state of switch 180 is altered, activated and deactivated, by a switch paddle or lever 184.

When the cover 108 is closed to the base plate 106, the switch lever is captured between the walls 172, 174. The switch lever is moved to activate or deactivate by the walls 172, 174 respectively. A downward movement of the handle 110 causes switch activating wall 172 to toggle the switch paddle 184 down to an activated position, at which time the "trigger" 160 locks the handle into the downward "alarm" position (FIG. 7B or 7D). To reset the switch 180 to "normal", cover 108 must be opened to allow handle 132 to return to the non-activated state (FIG. 3) by force from the spring 134. Upon closing the cover 108, the ramped portion 174*a* (FIG. 10) slidingly engages switch paddle 184 and forces it upwardly. The handle 132 and switch 180 are now both reset to normal.

Switch 180 snap-fits into baseplate 106. Opening the cover 108 does not change the state of switch 180. Hence cover 108 can be opened for inspection and maintenance without setting off an alarm. Alternately, cover 108 could be opened and a switch 214 depressed to generate a signal, distinguishable from the alarm signal generated by switch 180. Opening or closing the cover 108 does not change the state of the switch 214.

A printed circuit board or other control circuit could be positioned within an open space 193 located upwardly of the switch 180 and mounted to one or more of the screw bosses 195 provided. A possible vertically elongated orientation is shown as 193*a* and a possible horizontally elongated orientation is shown as 193*b*. A plurality of conductor pins 316 (described below) are exposed beneath the PCB locations 193*a*, 193*b*. The conductor pins can be connected to contacts on a PCB board in similar fashion as described below.

The base plate 106 includes a back wall 196 having a variety of openings 198 for supporting the pull station 100 on an electrical box, a wall surface or other structure. A comer wall 202 is arranged to be captured by the lock cam 142 to maintain the cover 108 locked to the base plate 106. The lock cam 142 is rotated to abut a backside surface 202*a* of the comer wall 202.

Figure 3:
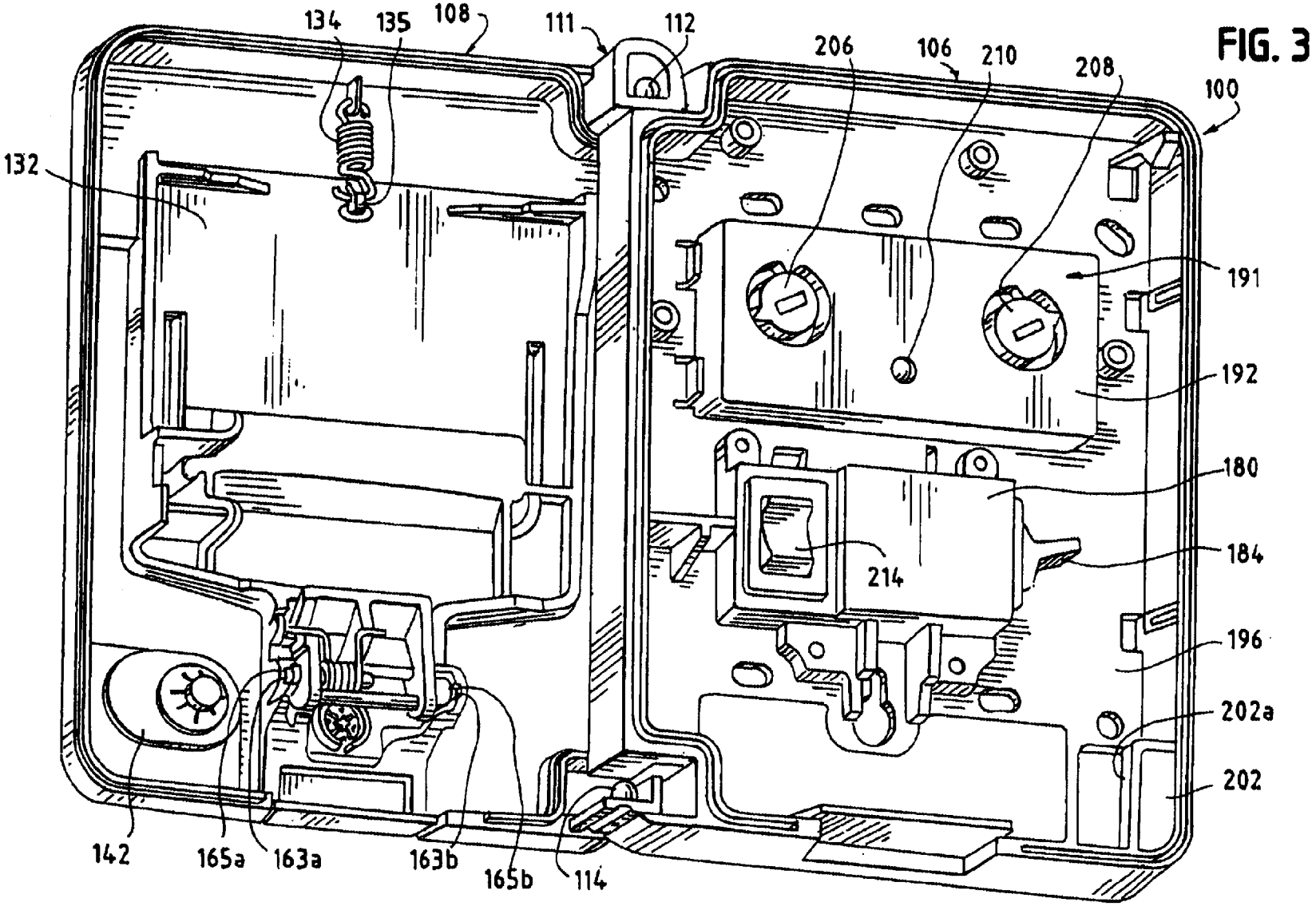
FIG. 3 is an elevational view of the pull station of FIG. 2 with the cover completely opened.

FIG. 3 illustrates one configuration of the pull station with a monitor module 191. The monitor module 191 includes a case 192 that carries address setting dials 206, 208 and an LED 210. The monitor module in this configuration, provides an interface between a centralized alarm monitoring system and the pull station. The address setting dials each include for example 10 digit settings, 0 through 9, so that the dials together provide a possibility of address settings of 0 through 99. The address settings provide a unique address number to the particular pull station so that when actuated the centralized monitoring system can identify the location of the pull station compared to other pull stations on the loop of the monitoring system. A known monitoring system is model MMX-101, manufactured by the System Sensor division of Pittway Corporation.

For the LED 210 to be observable in operation, the handle 132 must be transparent or translucent, or the cover 108 opened. The body portion 132 of the handle 110 is preferably composed of a transparent or translucent material, such that the LED 210 can be observable from outside the closed pull station.

The switch 180, when actuated, can signal a local or centralized alarm signal. Alternatively, the switch 180 can be used in conjunction with the optional rocker switch 214 to trigger a "presignal" alarm which requests an inspection of the pull station to ascertain if the actuation of the alarm is legitimate, i.e., is not a nuisance alarm. In this case, an authorized person with a key to the cover lock would open the cover to reset the handle and, if the emergency condition is legitimate, the person could at that time actuate a rocker switch 214 to cause a general alarm, either locally or at the centralized system. The rocker switch is entirely secured inside the cover so that only an authorized person can actuate the general alarm. This presignal feature is also useful for testing the operability of pull stations without actually sounding unnecessary alarms. Switch 214 can be used in different ways without departing from the spirit and scope of the present invention. Switch 214 is not activated by the movement of the handle 132.

Figure 4:
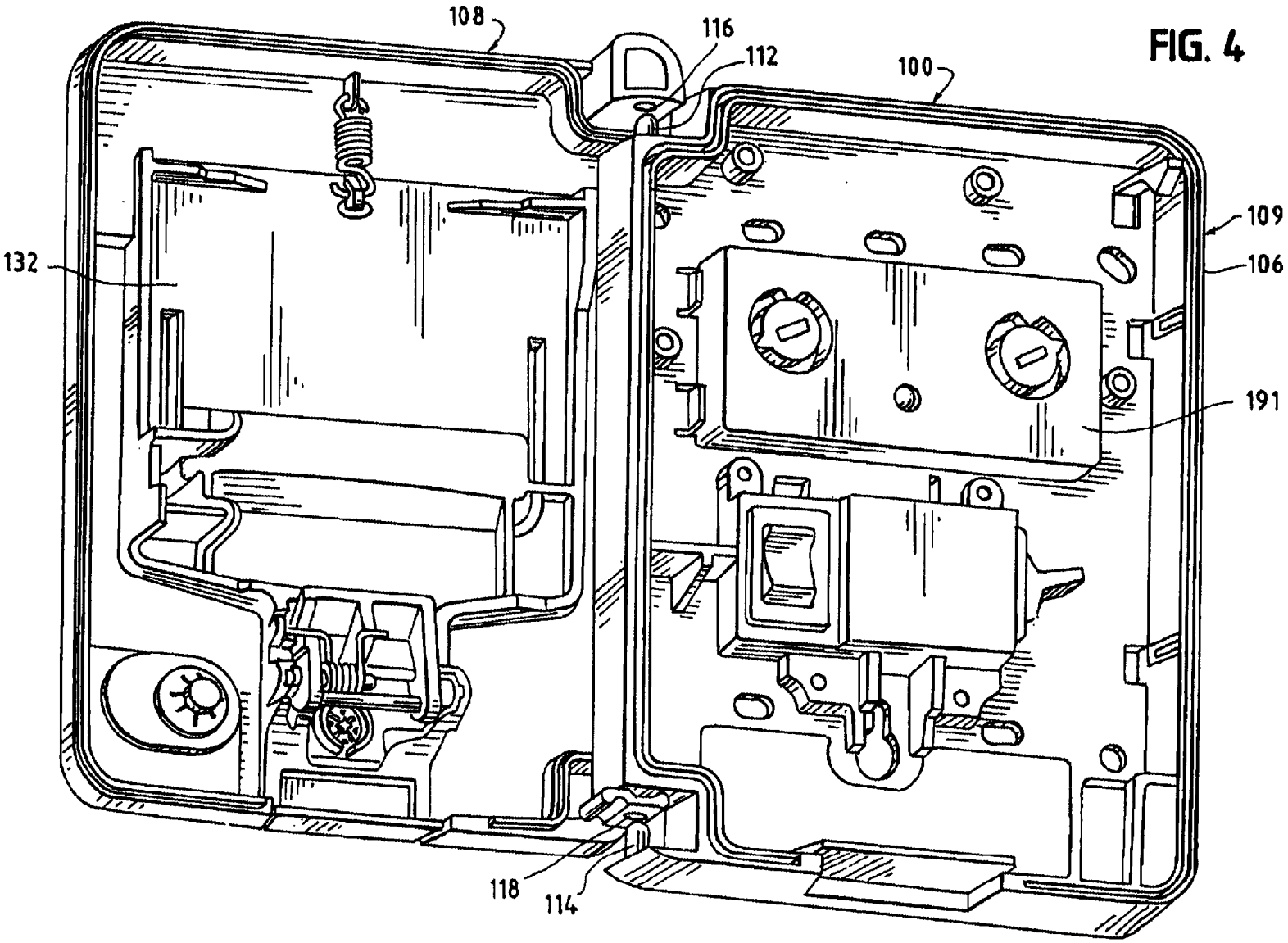
FIG. 4 is an elevational view of the pull station of FIG. 3 with the cover disengaged from the baseplate.

FIG. 4 illustrates the cover 108 opened with respect to the base plate 106. The hinge sockets 116, 118 have been lifted out of engagement with the hinge pins 112, 114. The cover 108 can then be separated from the base plate 106. Installation is according to a reverse procedure. No fasteners are required to install the cover to the base plate.

Figure 5:
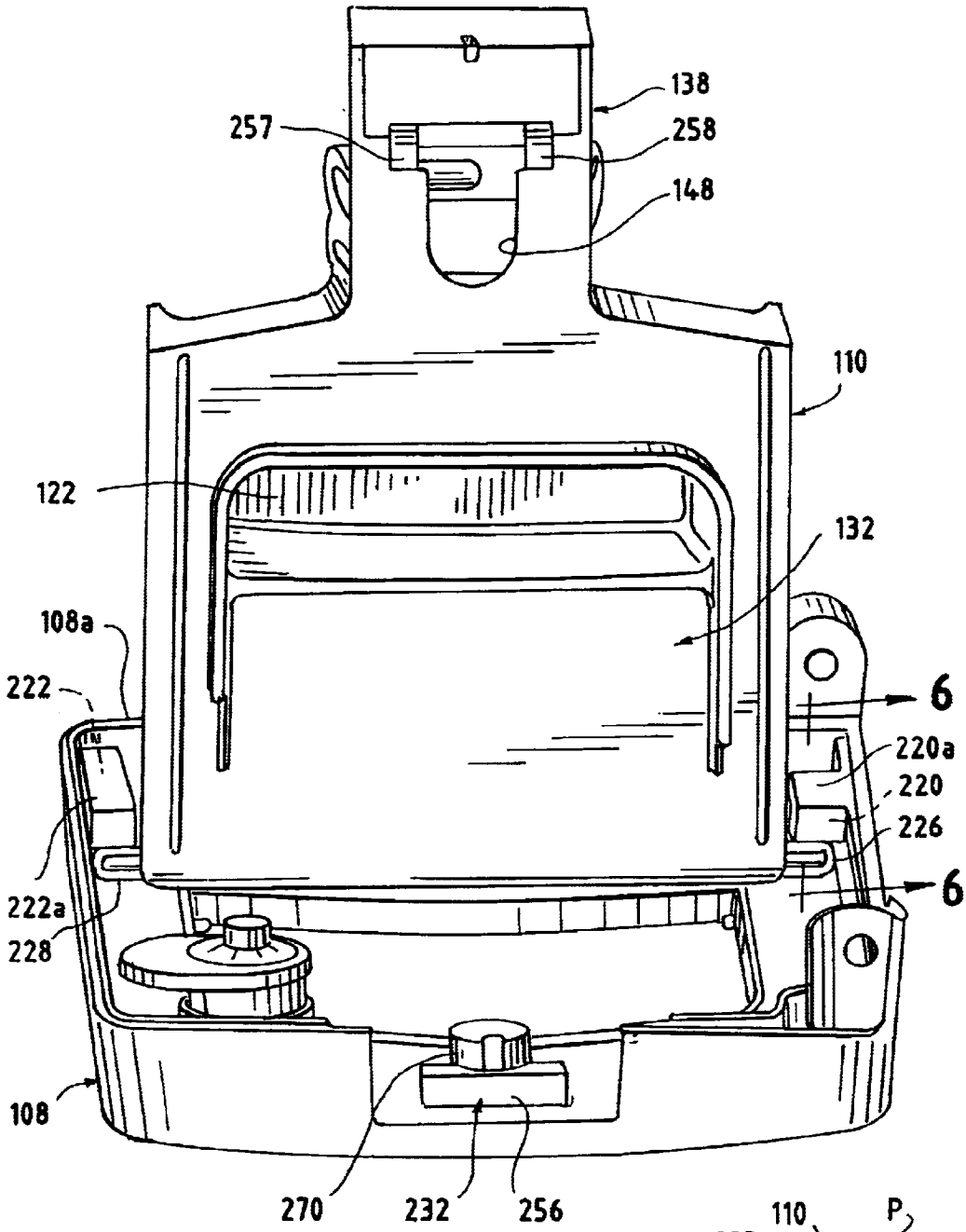
FIG. 5 is a perspective new of the handle partially engaged into the cover.
Figure 6:
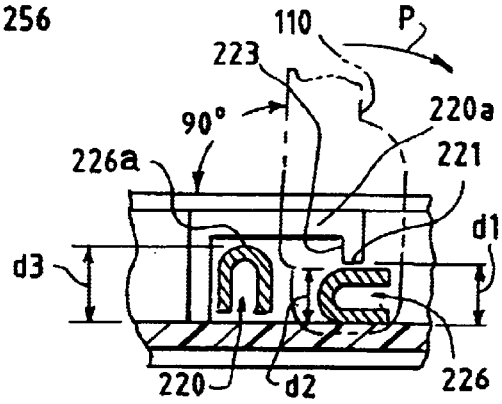
FIG. 6 is a side view of the initial engagement and rotation into position of the handle with regard to the cover.

As illustrated in FIG. 5, the cover 108 includes side channels 220, 222 formed by substantially L-shaped wall members 220*a*, 222*a* at a top end 108*a* of the cover. During assembly of the handle to the cover 108, the handle 110 is positioned at about a 90 degree angle to the cover (as shown in FIG. 6). The handle 110 is then slid toward the top end 108*a* of the cover. The side channels receive laterally extending tabs 226, 228 therein. The handle 110 is then pivoted downwardly in the direction P toward the cover (as shown on FIG. 6) to its installed position in the cover. Once pivoted down, the handle 110 can not be pulled out of the side channels/traces 220, 222.

An anchor member 232 is fixed to the cover 108 either before or after the handle is pivoted to the installed position, depending on the handle actuation mode. The anchor member 232 is positioned to be received in the slot 148.

For a press in and slide down mode of handle operation, the anchor member 232 is attached as shown in FIG. 5 with the stop portion 256 registering with stop grooves 257, 258 formed on a front side of the wall portion 144 of the extension portion 138. The engagement of the stop portion with the stop grooves prevents sliding of the handle with respect to the cover unless the handle is first depressed inwardly to disengage the stop grooves from the stop portion as described in FIGS. 7A and 7B.

For a slide-only mode of handle operation, the anchor member is turned upside down and rotated 180 degrees from the position shown in FIG. 5. The anchor member is attached to the cover, through the slot 148, after the cover is pivoted to the installed position. Once fixed into position within the slot 148, the anchor member 232 prohibits the handle from being pivoted away from the installed position, and only allows sliding movement of the handle within the housing 109 as described in FIGS. 7C and 7D.

FIG. 6 illustrates the position and orientation of the tab 226 as it enters a mouth 221 of the channel 220. The mouth has a clearance dimension d1. The tab 226 has a width dimension d2 less than d1. When rotated 90 degrees (shown dashed as 226) the tab 226 has a height dimension d3 greater than d1 . Thus, the tab can be slid past the mouth 221 and then rotated 90 degrees as shown, thereby being captured in the channel for sliding therein. The tab provides a rounded sliding surface 226*a*. In addition, a limit stop is established by a back side 223 of the mouth 221. The channel 222 and tab 228 are configured substantially identically to operate in a substantially identical fashion as the channel 220 and the tab 226.

Figure 7A:
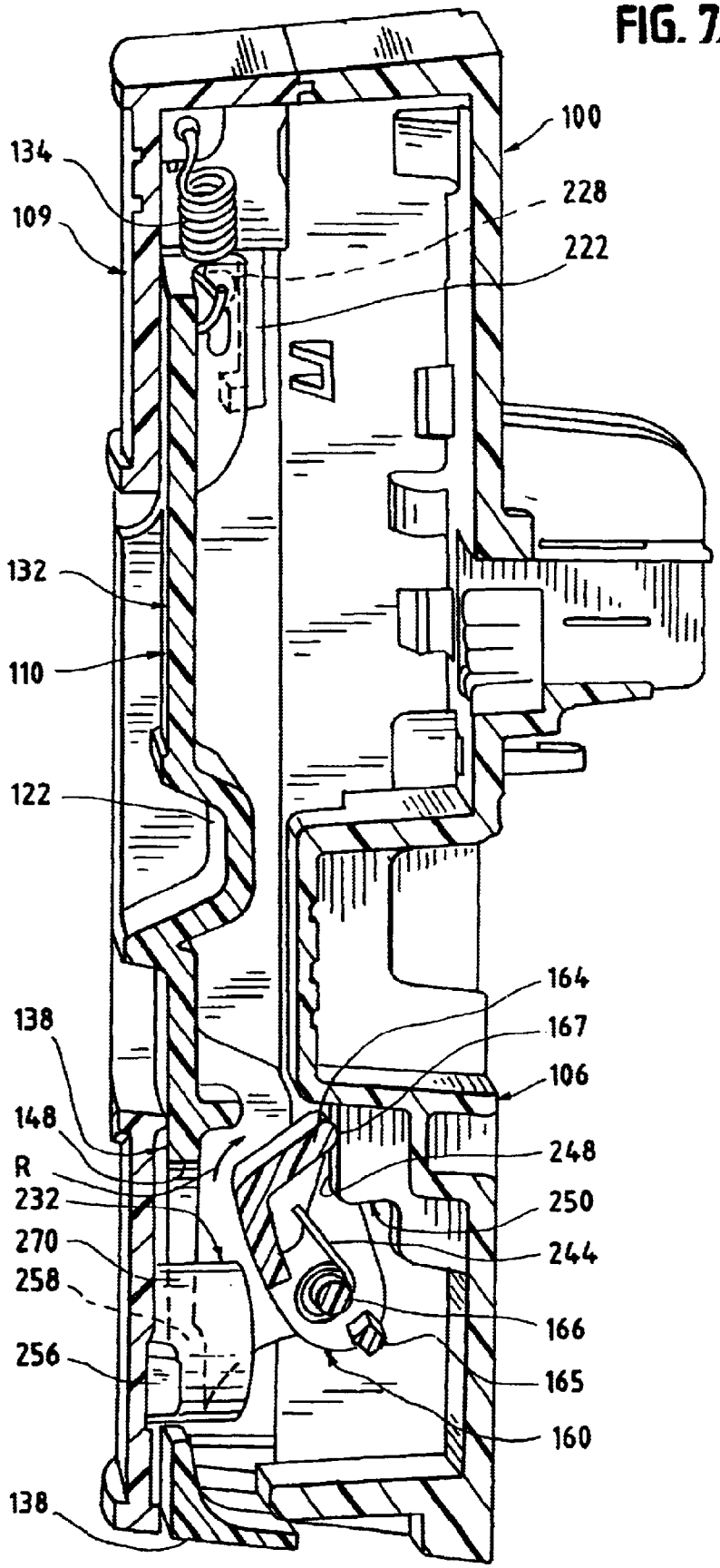
FIGS. 7A and 7B illustrate the interaction between the cover, the handle and the latch mechanism of a dual action, press in and slide down mode of handle operation, progressively as the handle is moved into its alarm state.
Figure 7B:
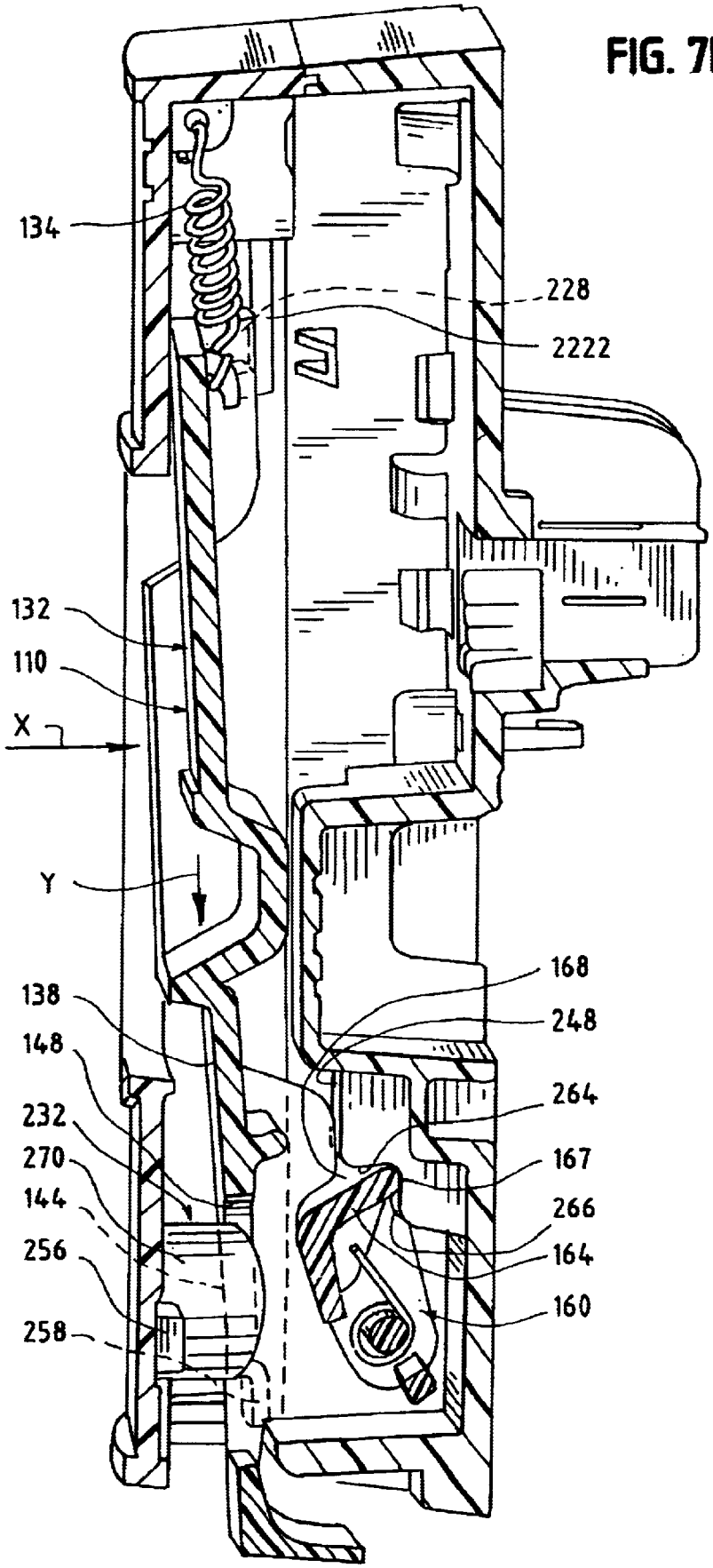

FIGS. 7A and 7B illustrate the operation of the handle 110 within the housing 109 when configured in a press in and slide down handle operating mode.

In FIG. 7A, the handle 110 is illustrated in a ready state before movement. The torsion spring 244 biases the latch member in the rotational direction R. The base plate 106 includes at least one stepped wall 250 having a forward surface 248 arranged at a first distance to a rear side of the cover, a contiguous perpendicular surface 264, and a contiguous rearward surface 266 arranged at a second distance to the rear side of the cover. The first distance is less then the second distance.

In the disclosed embodiment, the stepped wall 250 is formed by two parallel and substantially identical stepped wall portions 250*a*, 250*b*. The latch element 164 presses the latch tip 167 to the forward surface 248 of the stepped wall 250 formed on the base plate 106. A reaction force from the latch 164 presses the extension portion 138 of the handle 110 resiliently but firmly against the cover 108. The stop portion 256 of the anchor member 232 is received into the stop grooves 257, 258 to prohibit vertical movement of the handle.

As shown in FIG. 7B, the handle 110 is pushed inwardly in the direction X. The front wall portion 144 has been depressed to disengage the stop grooves from the stop portion 256 of the anchor member 232. The tabs 226, 228 have been slightly pivoted and slid within the channels 220, 222. The handle has been slid downwardly in the direction Y guided by a base portion 270 within the slot 148.

The latch tip 167 has slid across the forward surface 248. The handle 110 has dropped below the forward surface 248 to underlie the perpendicular surface 264, and is depressed against the rearward surface 266. The latch 164 has been rotated clockwise by force from the torsion spring 244. A vertical upward retraction force imparted by a person on the handle 110 would cause the latch element 164 to further rotate clockwise to a position wherein the latch end face 168 would be forced against the perpendicular surface 264, opposing retraction of the handle.

Figure 7C:
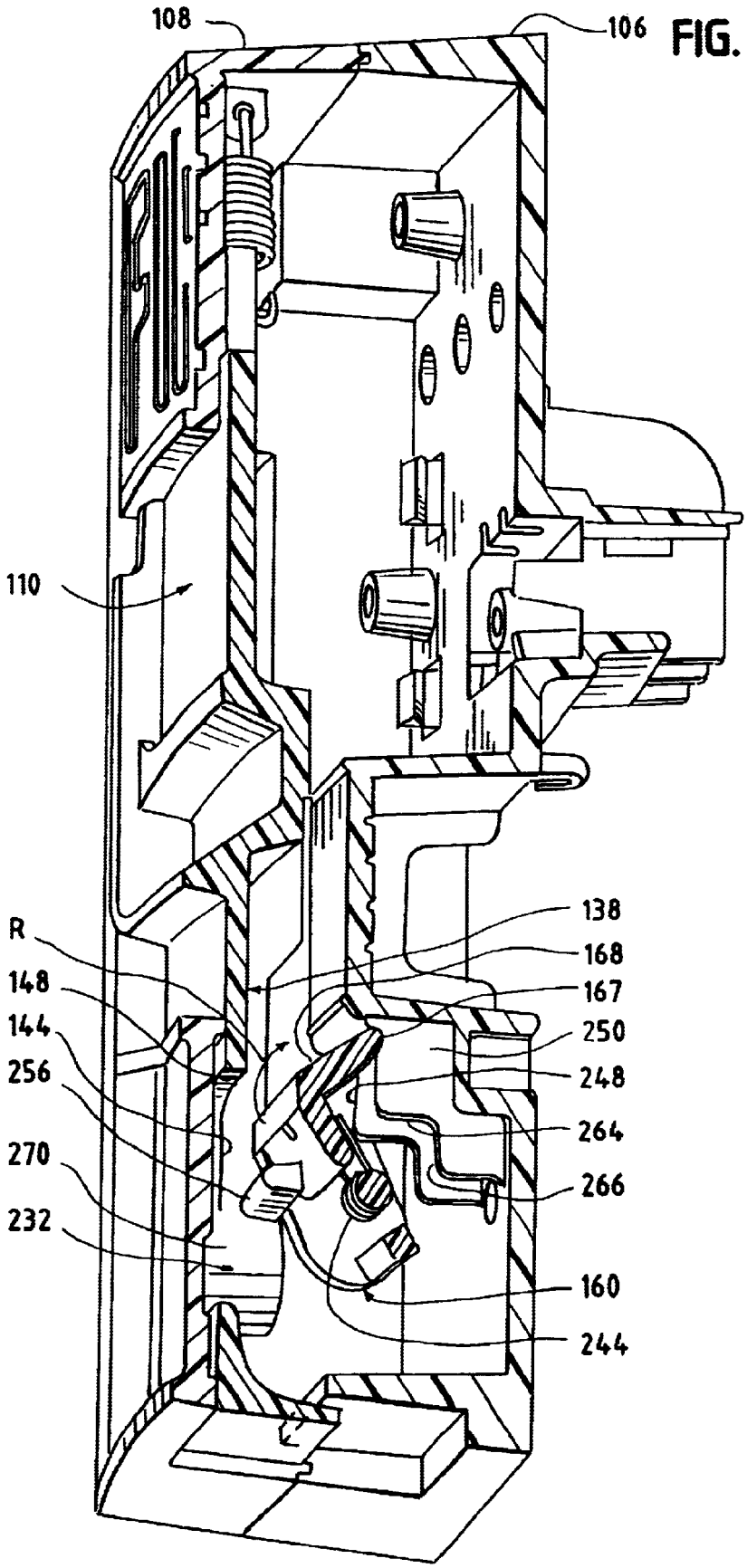
FIGS. 7C and 7D illustrate the interaction between the cover, the handle and the latch mechanism of a single action, slide down only mode of handle operation, progressively as the handle is moved into its alarm state.
Figure 7D:
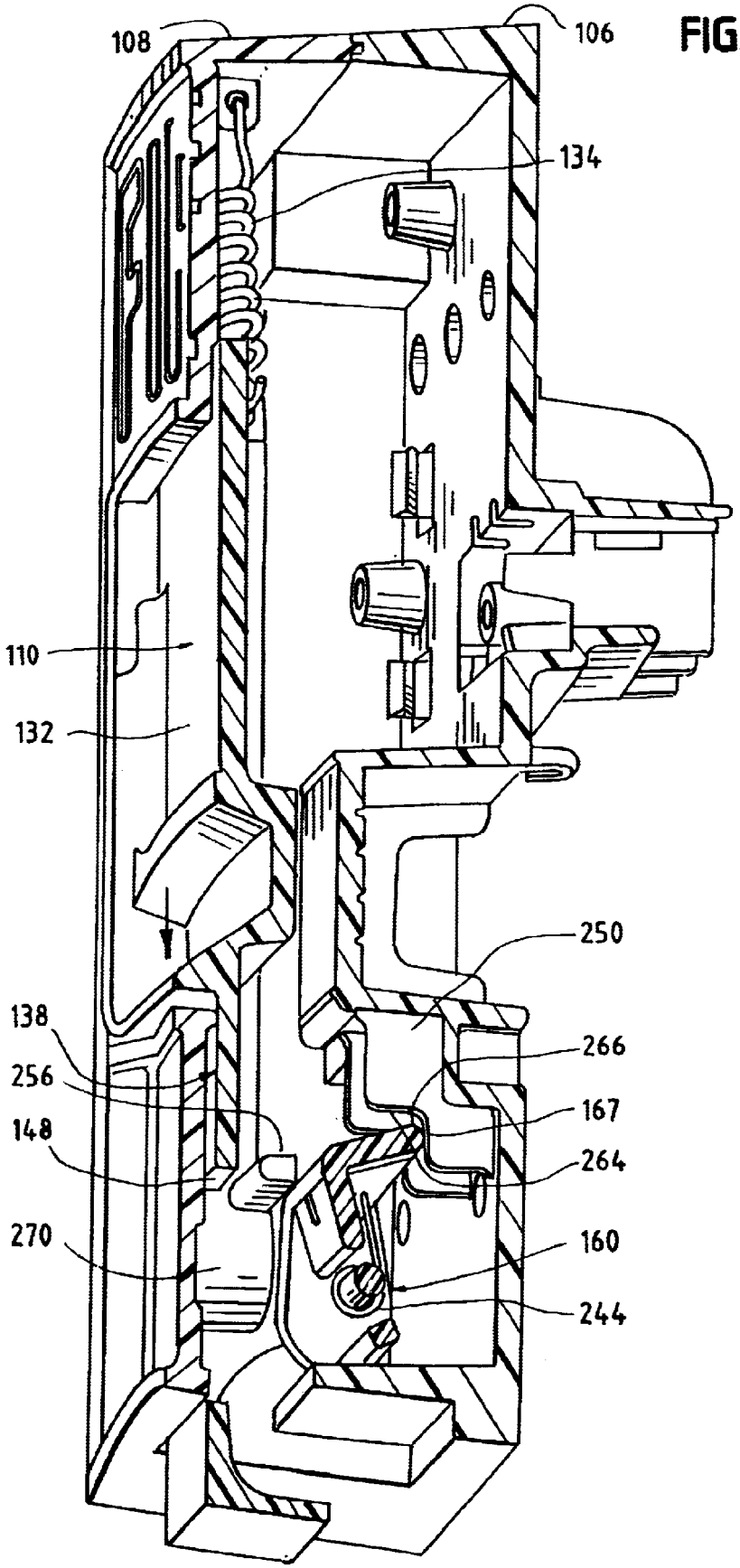

FIGS. 7C and 7D illustrate the operation of the handle 110 within the housing 109 when configured in a slide down only handle operating mode.

In FIG. 7C, the handle 110 is illustrated in a ready state before movement. The torsion spring 244 biases the latch member in the rotational direction R. The latch element 164 presses the latch tip 167 to the forward surface 248 of the stepped wall 250 formed on the base plate 106. A reaction force from the latch 164 presses the extension portion 138 of the handle 110 resiliently but firmly against the cover 108. The stop portion 256 of the anchor member 232 is located on the rear side of the front wall portion 144 to prevent rearward movement of the handle.

As shown in FIG. 7D, the handle 110 is pushed downwardly in the direction Y guided by the base portion 270 within the slot 148. The latch tip 167 has slid across the forward surface 248 and has dropped below the forward surface 248 to underlie the perpendicular surface 264. The latch has been rotated clockwise by force from the torsion spring 244 and presses against the rearward surface 266. A vertical upward retraction force imparted by a person on the handle 110 would cause the latch element 164 to further rotate clockwise to a position wherein the latch end face 168 would be faced against the perpendicular surface 264, opposing retraction of the handle.

In either of the configurations of FIG. 7B or FIG. 7D, to reset the handle, the cover need only be unlocked and opened. The spring 134 will automatically retract the handle 110 upwardly. The latch 164 will move away from and disengage the stepped wall 250. When the cover is then re-closed, the latch will be resiliently rotated slightly counterclockwise (as shown in FIGS. 7A and 7C) to assume a position with the latch tip 167 pressed against the forward surface 248.

FIG. 8 illustrates the anchor member 232 oriented for a press in and slide down mode of handle operation, wherein the base portion 270 extends rearwardly of the stop portion 256. The base portion 270 is attached to the cover by a stake 271, formed with the cover and having a cross-shaped cross section. The stake 271 frictionally engages a channel 272 in the base portion. The channel has a matching cross-shaped cross section.

FIG. 9 illustrates the anchor member oriented for a slide only mode of handle operation. In this embodiment the anchor member 232 has been turned upside down and rotated 180 degrees so the stop portion 256 overlies the front wall portion 144. The base portion 270 is attached using the stake 271 as previously described.

In this arrangement, the handle 110 is depressed downwardly but not inwardly. The stop portion prevents inward movement of the front wall portion 144 and guides the downward movement of the handle 110. During sliding of the handle, the base portion 270 passes through the elongated slot 148 which guides the sliding movement, and prevents lateral movement, of the handle.

For more sure retention of the anchor 232, in either embodiment of FIG. 8 or 9, the stake 271 can be "heat staked" (i.e., mushroomed over) creating an enlarged head 271*a* to prevent unwanted removal during operation, as illustrated in FIG. 9A.

FIG. 10 illustrates the latch mechanism 160 pivotally connected between the sidewalls 150, 152. The torsion spring 244 surrounds the rod 166 and has a first end 244*a* pressed against and retained by a hole 150*a* in the side wall 150 and an opposite end 244*b* connected to a gusset plate 164*a* of the latch element 164. The spring 244 is configured to urge the latch element 164 to pivot about the rod 166.

The switch activating wall 172 and the switch deactivating wall 174 are shown in FIG. 10. A slot 173 is arranged between the walls 172, 174 in order to receive the switch lever 184 into a space between walls 172, 174. The edge surface 174*a* of the wall 174 which partially defines the slot 173 can act on the switch lever to reset the switch during resetting of the pull station, i.e., the switch is automatically reset by the closing motion of the cover 108.

Figure 12:
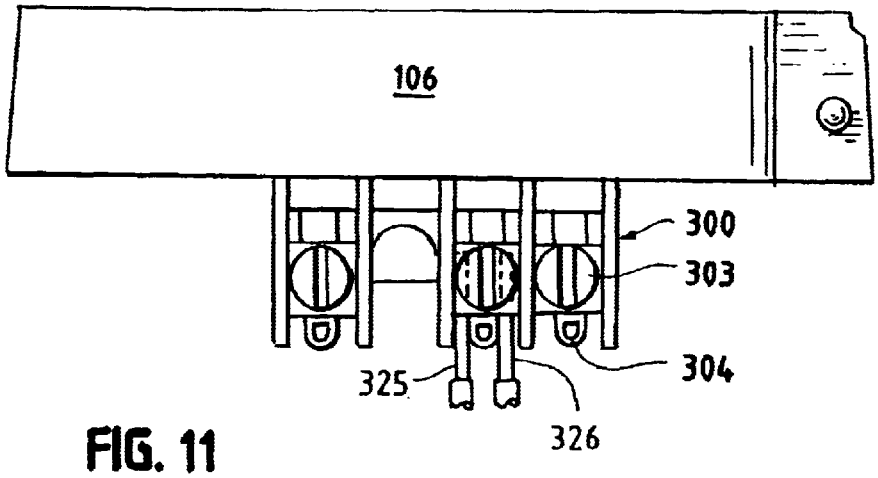
FIG. 12 is a top plan view of the baseplate shown in FIG. 11.
Figure 11:
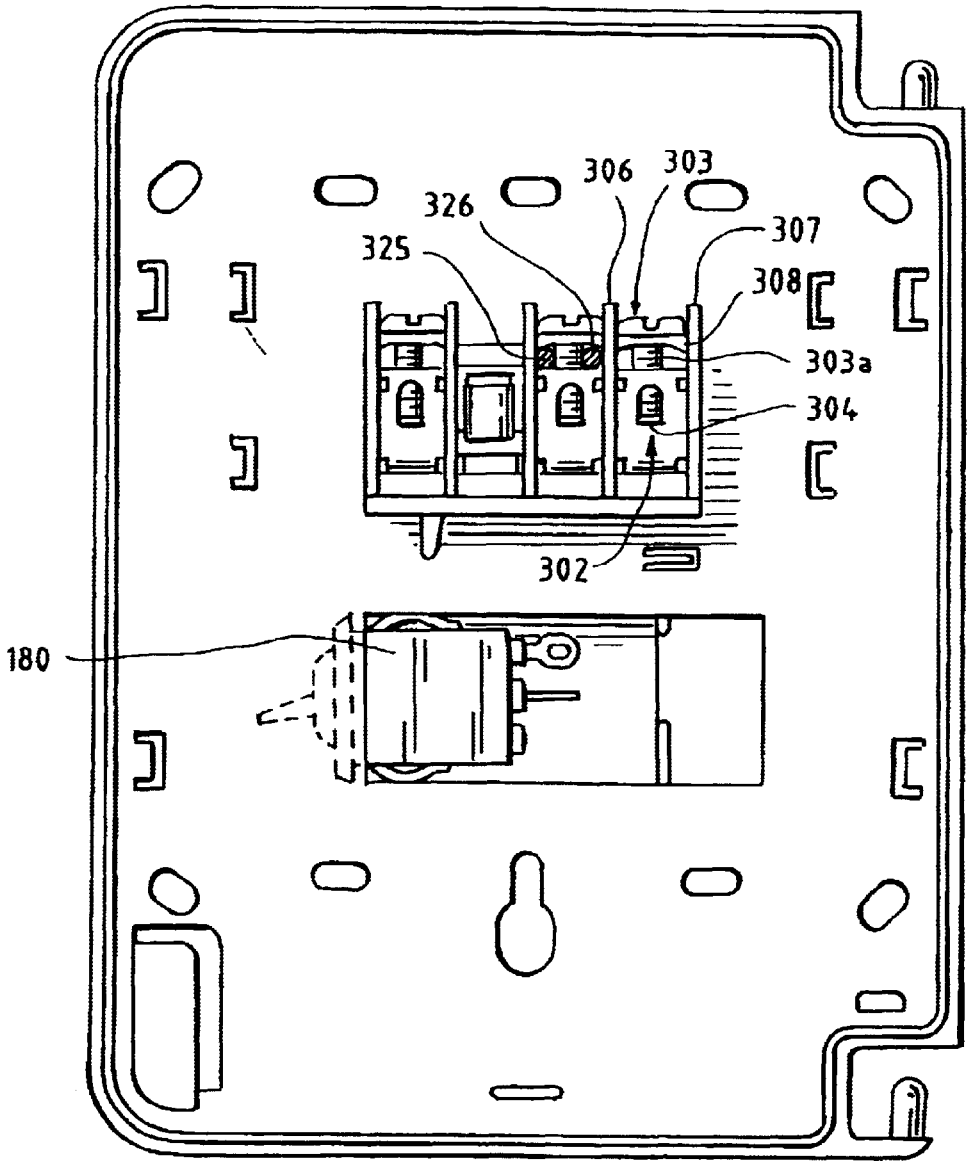
FIG. 11 is a rear-view of the baseplate shown in FIG. 4.

FIGS. 11 and 12 illustrate a terminal block 300 formed on a back side of the base plate 106. The block 300 carries a plurality of terminals 302, advantageously at a standard spacing of 0.375 inches. Each of the terminals includes a screw contact terminal 303 and a loop solder terminal 304.

The screw contact 303 is preferably configured to allow for the electrical connection of two solid wires 325, 326, having a size of between 18 to 12 AWG. One of the two wires is located on each side of the screw shaft 303*a*.

Each screw contact 303 is positioned between two barrier walls 306, 307. These walls prevent the wires from shifting while the screw contact 303 with a square washer 308 is being turned. The screw contact is preferably a captivated screw having a size #8/32.

The loop solder terminal 304 allows for the permanent soldered connection of a wire thereto.

Thus, each terminal block, as illustrated, can accommodate four electrical connections. The U-shaped body 310 is formed using one continuous piece of metal.

Figure 13:
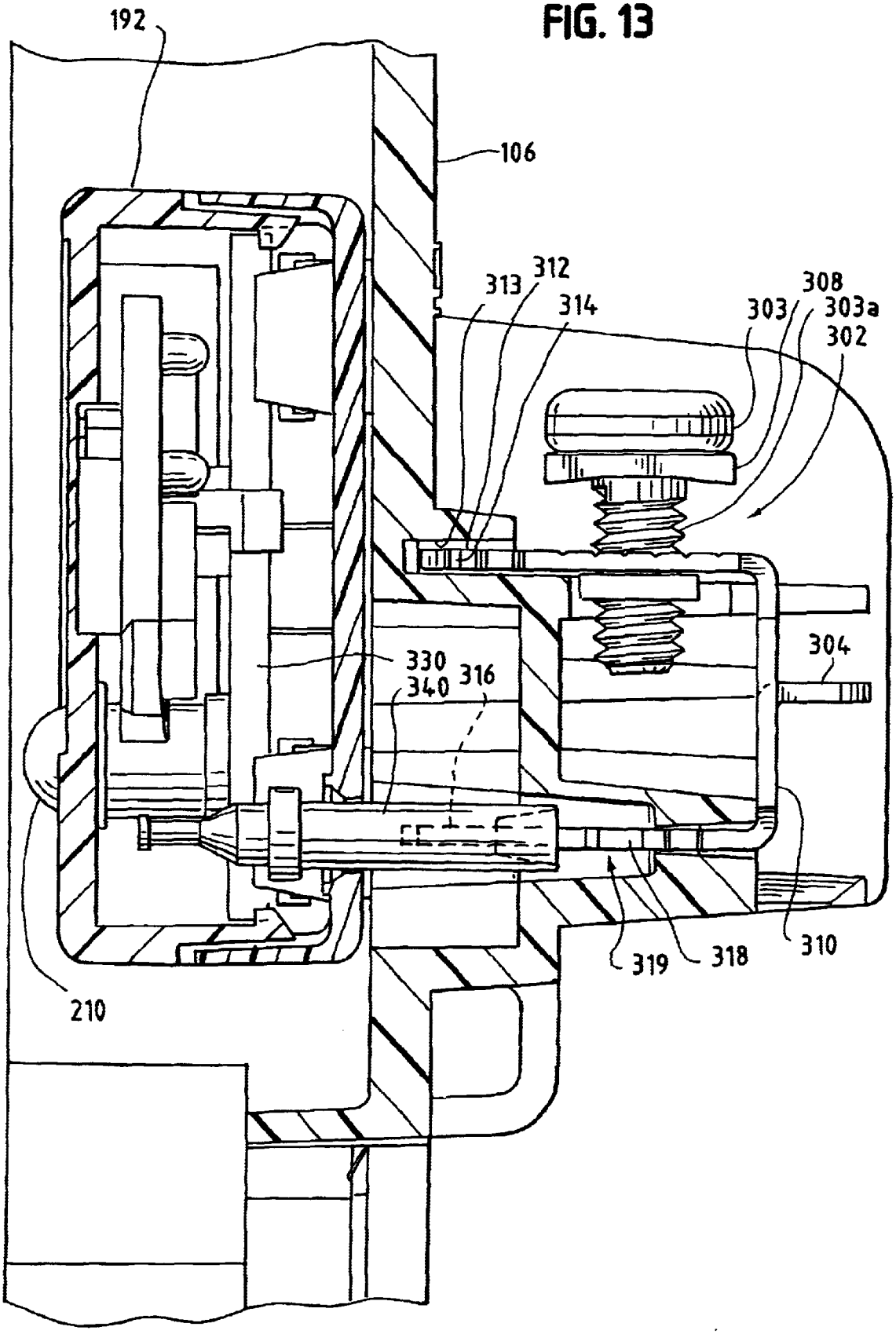
FIG. 13 is a cross sectional view taken generally along line 13—13 of FIG. 10.
Figure 16:
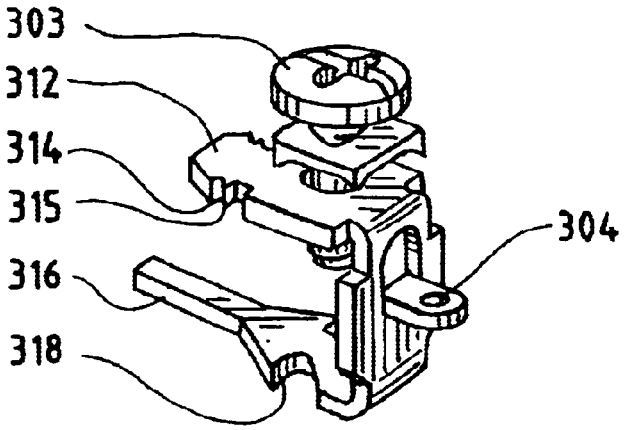
FIG. 16 is an enlarged perspective view of one contact assembly taken from FIG. 13.

FIGS. 13 and 16 further illustrate the terminals. Each has a U-shaped body 310 with an anchor portion 312 fixed into a slot 313 formed in the plastic base plate 106 by barbs 314, 315 and a conductor pin 316 fixed into the base plate by barbs 318. The conductor pin 316 extends into a cylindrical hollow 319 of the base plate 106. Pin 316 contacts a conductor inside of the pull box. The screws 303 are oriented such that they are accessible from the top of the pull box even when it is located adjacent to the electrical box.

Figure 17:
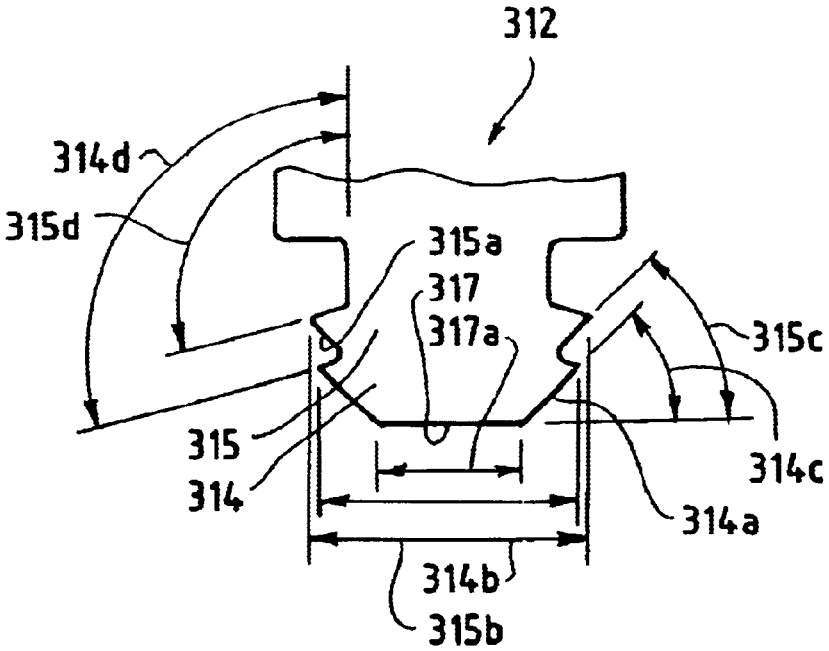
FIG. 17 is a fragmentary, enlarged plan view of a portion of the contact assembly shown in FIG. 16.

FIG. 17 illustrates that the barb 314 has a leading flat surface 317 having a width 317*a*. On opposing sides of the leading flat surface 317 are inclined surfaces 314*a* having an overall width 314*b* and each inclined at an angle 314*c*. The back sides of the barb are inclined at an angle 314*d*. Arranged adjacent to the barb 314 is a barb 315. The barb 315 has opposing angled surfaces 315*a* having an overall width 315*b* and each inclined at an angle 315*c*. The barb 315 has back sides each inclined at an angle 315*d*.

According to the invention, the distance 315*b* is greater than the distance 314*b*. As the anchor is pressed into the slot 313, the plastic of the base plate is forced to flow over the smaller barb 314 to be opened further to assist in receiving the larger barb 315 for a fixation of the anchor into the slot. This allows each barb to be fixed sequentially, into uncut plastic.

According to the preferred embodiment of the invention, the anchor portion 312 has the following dimensions (inches) and angles (degrees):

314*b*=0.230
314*c*=45
314*d*=105
315*b*=0.250
315*c*=45
315*d*=105
317=0.131

FIGS. 13 through 15 illustrate the case 192 which encloses a circuit board 330. The circuit board carries the LED 210 and is electrically connected thereto.

The case 192 includes a cover member 193 which snap engages a base member 194, by means of resilient hooks 195 and apertures 196 applied therebetween, and/or by resilient hooks 195 and a ledge 197 applied therebetween. When the case 192 is assembled and then pressed into the back plate 106, a plurality of tubular connectors 340 slide into the cylindrical hollows 319 of the base plate 106 and electrically connect the terminal pins 316 to the circuit board 330. Terminal pins 316 are oriented at 90 degrees to screws 303.

It will also be understood that the connector block 300 could be mounted, for example, on a printed circuit board and used in other electrical units or applications. The type of electrical unit is not a limitation of the present invention.

In another embodiment, the handle 110 can be removed and replaced with a snap in bezel. The contacts from a switch or circuitry mounted in the bezel can connect into the pins of connector block 300. Alternately, the plug-in module can include additional circuiting to carry out different, non-pull box functions.

From the foregoing, it will be observed that numerous variations and modifications may be effected without departing from the spirit and scope of the invention. It is to be understood that no limitation with respect to the specific apparatus illustrated herein is intended or should be inferred. It is, of course intended to cover by the appended claims all such modifications as fall within the scope of the claims.

The invention claimed is:

1. A terminal block comprising:

a non-conductive body having a plurality of connector receiving, spaced apart slots, a plurality of substantially identical connects wherein each of the connectors comprises a metallic body portion which is attached to the non-conductive body, and includes a screw terminal, a protruding perforated solder lug displaced from the screw terminal and a connector pin; and wherein the body portion has a center section which carries the protruding solder lug and two parallel extensions at ninety degrees to the center section wherein one extension carries the screw terminal and wherein the other extension carries the connector pin.

2. A terminal block as in claim 1 wherein each connector is formed of a U-shaped, conductive metallic element.

3. A terminal block as in claim 1 wherein each connector is spaced from an adjacent connector by a non-conductive wall integral with the body.

4. A terminal block as in claim 1 wherein each connector pin includes at least one element for lockingly engaging the body.

5. A terminal as in claim 4 wherein the element for locking comprises at least one barb.

6. A terminal block as in claim 4 wherein the element for locking comprises at least one barb non-removably embedded into a part of the body.

7. A terminal block as in claim 6 wherein part of the body flows around the barb thereby inhibiting removal of the connector from the body.

8. A terminal block comprising:

a non-conductive body having a plurality of connector receiving, spaced apart slots;

a plurality of substantially identical connectors wherein each of the connectors comprises a metallic body portion, which is attached to the non-conductive body, and includes a screw terminal, a solder lug and a connector pin, the solder lug is integrally formed with the metallic body portion and protrudes therefrom, the body portion has a center section which carries the protruding solder lug and two parallel extensions at ninety degrees to the center section wherein one extension carries the screw terminal and wherein the other extension carries the connector pin, the protruding solder lug extends substantially parallel to the two extensions and is perforated; and wherein each connector pin is engageable from a different surface of the body than is the screw terminal and wherein each connector pin is oriented so as to be generally perpendicular to a screw of the screw terminal.

9. A terminal block as in claim 8 wherein the connector pins extend parallel to one another and each terminates beneath a protective surface of the body.

10. A terminal block as in claim 8 wherein each connector pin includes at least one barb for lockingly engaging the body.

* * * * *